United States Patent [19]

Binsbergen et al.

[11] 4,051,051

[45] Sept. 27, 1977

[54] LUBRICATING OIL COMPOSITIONS CONTAINING AN ACYCLIC POLYMER OF CYCLOPENTENE

[75] Inventors: Frederik L. Binsbergen; Dick J. Van Namen, both of Amsterdam, Netherlands

[73] Assignee: Shell Oil Company, Houston, Tex.

[21] Appl. No.: 698,611

[22] Filed: June 21, 1976

[30] Foreign Application Priority Data

June 24, 1975 United Kingdom ..... 26721/75

[51] Int. Cl.[2] ..... C10M 1/18

[52] U.S. Cl. ..... 252/59

[58] Field of Search ..... 252/59; 44/80, 62

[56] References Cited

U.S. PATENT DOCUMENTS

| | | | |
|---|---|---|---|
| 3,502,631 | 3/1970 | Anderson | 526/332 X |
| 3,865,124 | 2/1975 | Kohler | 252/59 X |
| 3,963,792 | 6/1976 | Takeshita | 252/59 X |

FOREIGN PATENT DOCUMENTS

| | | |
|---|---|---|
| 1,340,524 | 12/1973 | United Kingdom |

*Primary Examiner*—Delbert E. Gantz
*Assistant Examiner*—J. Thierstein
*Attorney, Agent, or Firm*—Ronald R. Reper

[57] ABSTRACT

The viscosity index and pour point of oil compositions are improved by the addition of certain low molecular weight, substantially acyclic polymers of cyclopentene.

3 Claims, No Drawings

LUBRICATING OIL COMPOSITIONS CONTAINING AN ACYCLIC POLYMER OF CYCLOPENTENE

BACKGROUND OF THE INVENTION

It is disclosed in U.S. Pat. No. 3,242,667 that polycyclic compounds, substantially free of olefinic unsaturation, derived from cyclopentene may be used as a jet-engine fuel. It is also disclosed in U.S. 3,502,631 that polycyclic compounds, also free of olefinic unsaturation, may also be used as synthetic lubricants. It is also disclosed in UK 900,202 that polycyclopentane is an ineffective additive for middle distillate fuels. These disclosures relate to compounds which are substantially different in structure from acyclic polymers of cyclopentene.

U.S. Pat. No. 3,865,124 claims hydrocarbon oil compositions, having reduced frictional drag when flowing through pipelines or other conduits, comprising a hydrocarbon oil and a minor proportion of a polymer of cyclopentene. The preferred molecular weights of the polymers are between $5 \times 10^5$ and $10^7$, particularly between $10^6$ and $5 \times 10^6$.

SUMMARY OF THE INVENTION

It has now been found that certain low molecular weight substantially acyclic polymers of cyclopentene, which may be partially hydrogenated, improve the viscosity index and other properties of oils such as lubricating oils and fuels.

According to the present invention, an oil composition comprises an oil and a minor proportion of an acyclic polymer of cyclopentene, which may be partially hydrogenated, having a molecular weight of between $1.0 \times 10^4$ and $3.0 \times 10^5$, preferably in the range from about $3.0 \times 10^4$ to about $1.5 \times 10^5$, inclusive.

DESCRIPTION OF PREFERRED EMBODIMENTS

The oil component of the above composition may be of a natural or synthetic nature but preferably is a hydrocarbon oil e.g. a mineral oil. The oil is a crude oil; a lubricating oil; a fuel oil e.g. a heavy residual fuel or a distillate fuel such as gasoline or middle distillate fuel; a functional oil e.g. a hydraulic oil, a heat transfer oil or an automatic transmission fluid; or a grease.

It has been discovered that substantially acyclic polymers of cyclopentene improve the viscosity index of oil and are wax-crystal modifiers e.g. they are able to lower the pour point of oils. Consequently, such polymers are particularly useful additives for lubricating oils, such as hydrocarbonaceous lubricating oils of the low, medium and high viscosity index type. The aforesaid polymers are suitably present in the composition in amounts ranging from 0.025 to 10%w, although for normal applications the polymers will be present in amounts of from about 0.1 to 4.5%w, based on weight of composition.

Acyclic or substantially linear polymers of cyclopentene may be prepared by any convenient process but are preferably prepared by polymerizing cyclopentene in the presence of chain-terminators or modifiers (e.g. from $10^{-4}$ to 5 mol %), such as acyclic monoolefins e.g. n-butene-1, n-butene-2, n-pentene-1, n-pentene-2 and 2-methyl-pentene-1. Other comonomers such as cyclic olefins, e.g. cyclobutene, cyclo-octene, cyclododecene, cyclododecatriene and cyclo-octadiene may also be present. Suitable reaction conditions and catalysts are well known in the art and are described e.g. in the following publications: British Pat. No. 1,129,186; British Pat. No. 1,340,524; British Pat. No. 1,329,997; Netherlands patent application No. 7205003; Netherlands patent application No. 7208618 and West German patent application No. 1,945,358.

The molecular weight of the aforesaid polymers is suitably expressed as the real weight average molecular weight (real $M_w$). It may be calculated from the Intrinsic Viscosity of the polymer as determined in Toluene at 25° C as as obtained by the equation:

$$\eta = 1.808 \times 10^{-4} \text{ real } M_w^{0.781}$$

If the acyclic polymers are partially hydrogenated then the degree of hydrogenation depends inter alia on the degree of solubility or crystallinity of the partially hydrogenated polymer in the oil component of the composition. Usually the degree of hydrogenation will be such that less than 70%, preferably less than 60% and more preferably less than 35%, of the initial unsaturation is removed. Conventional hydrogenation conditions may be used e.g. as described in British Pat. No. 1,355,341 for the hydrogenation of copolymers of conjugated dienes and vinyl aromatic compounds. If desired, the oil compositions according to the invention may comprise mixtures of partially hydrogenated and unhydrogenated polymers of cyclopentene.

Insofar as the oil compositions according to the present invention are lubricating oil compositions they may also contain one or more other lubricating oil additives such as further viscosity index improvers, pour point depressants, detergents, anti-oxidants, extreme-pressure additives, rust-inhibitors and metal-passivators.

The invention will now be illustrated by reference to the following Examples.

EXAMPLE 1

Preparation of an Acyclic Polymer of Cyclopentene (Polymer 1)

To a 9-liter (1) double walled reactor, equipped with stirrer, were added 5 l of dry toluene, 20 mole of dry and pure cyclopentene and 80 milliliters (ml) of a solution of $WCL_2(OC_6H_5)_4$ in toluene (conc. 50 millimole/liter). Sixty millimole of n-pentene-1 was then added and the mixture cooled to 0° C. Polymerization was then initiated by adding 80 ml of a 100 millimole/liter solution of $C_2H_5AlCl_2$ in n-hexane and continued for 3 hours after which it was terminated by the addition of 50 ml of methanol. The polymer was isolated and dried. The yield was 1006 g of polymer 1 havving an intrinsic viscosity in toluene at 25° C of 1.40 deciliters/g (dl/g) and a real $M_w$ of $1.02 \times 10^5$.

EXAMPLE 2

Preparation of an Acyclic Polymer of Cyclopentene (Polymer 2)

Example 1 was repeated with the difference that the amount of penetene-1 was 100 millimole. The yield was 1047 g of polymer 1 having an intrinsic viscosity of 0.92 dl/g and a real $M_w$ of $5.95 \times 10^4$.

EXAMPLE 3

Preparation of an Acyclic Polymer of Cyclopentene (Polymer 3)

Example 1 was repeated with the difference that the amount of pentene-1 was 80 millimole. The yield was 1500 g of polymer 3 having an intrinsic viscosity of 1.3 dl/g and a real $M_w$ of $9.3 \times 10^4$.

EXAMPLE 4

Preparation of a Hydrogenated Acyclic Polymer of Cyclopentene (Polymer 4)

Polymer 3 was dissolved in toluene to produce a 10%w solution. Four hundred grams of the polymer solution was hydrogenated in a 1—1 autoclave at a temperature of 80° C and a pressure of 40 bars, in the presence of a catalyst. The catalyst was prepared by mixing 60 ml of a 180 millimole/1 solution of aluminum triethyl in cyclohexane and hexane (50:50 mixture) with a 120 ml of a 60 mmole/1 solution of nickeloctanate in cyclohexane and hexane (50:50 mixture). The reaction time was 50 minutes. The polymer product was 31% hydrogenated.

EXAMPLES 5 and 6

Multi-grade lubricating oil compositions were prepared from polymers 1 and 2 was well as from a commercial hydrogenated styrene-butadiene tapered copolymer (read $M_w$ 77,000; polymer 5), a commercial hydrogenated styreneisoprene block copolymer (real $M_w$ 104,000; polymer 6) and a commercial poly(alkyl)acrylate (real $M_w$ 360,000; polymer 7).

The polymers were dissolved in a Quatar Marine HVI 60 base oil (viscosity index 95) together with 0.5%w of a commercial lube oil additive package containing a polyalkylsuccinimide and/or polyalkylsuccinate and a zinc dialkyldithiophosphate.

Table 1 gives the kinematic viscosities of the compositions at 302° F, 210° F and 100° F, their viscosity indices, their dynamic viscosities at 0° F and their shear stabilities. The kinematic viscosities were determined by ASTM D 445, the dynamic viscosities by ASTM D 2602 and the shear stabilities by German standard DIN 51382.

Particular significance is placed on the findings that much less of polymers 1 and 2 is required to produce the same $V_{k210° F}$ results as for polymer 5, that the $V_{k302° F}$ results of polymers 1 and 2 are much better than for polymer 6 and that the shear stabilities of polymers 1 and 2 much better than for polymer 7.

Table 1

| Example | Polymer | %w of polymer in composition | $V_{k302° F}$ (cSt) | $V_{k210° F}$ (cSt) | $V_{k100° F}$ (cSt) | $V_{D0° F}$ (of poise) | VI | Shear stability (%) |
|---|---|---|---|---|---|---|---|---|
| 5 | 1 | 1.9 | 7.8 | 14.8 | 107 | 17.3 | 193 | 11.0 |
| 6 | 2 | 2.8 | 7.9 | 18.7 | 133 | 18.0 | 196 | 4.0 |
| — | 5 | 3.5 | 7.3 | 19 | 144 | 23.0 | 168 | 5.0 |
| — | 6 | 1.7 | 5.5 | 19 | 146 | 18.0 | 176 | 12.0 |
| — | 7 | 5.6 | — | 18.7 | 112.7 | 22.0 | 196 | 17.0 |

EXAMPLE 7

A multi-grade lubricating oil composition was tested in a Cortina HT engine under standard conditions. The composition comprised Quatar Marine HVI 60 base oil (94.85%w), polymer 1 (1.8%w), a polyisobutylenesuccinic acid/pentaerythritol ester dispersant (2.75%w), an antioxidant (0.5%w), a polymeric pour point depressant (0.5%w) and a metal passivator (0.1%w). The composition had a piston cleanliness rating of 6.9 and a ring-sticking rating of 9.9 (on a scale 0–10 wherein, for both ratings, 10 represents the most desirable rating).

EXAMPLES 8 and 9

A lubricating oil composition was prepared by dissolving 0.2%w of polymers 3 (Example 8) and 4 (Example 9) in a Quatar Marine HVI 60 base oil (pour point (—) 18° C). The resultant compositions had pour points of (—) 24° C respectively. The pour points were determined by a standardized laboratory test comprising placing the test material in a test tube which is then cooled until the test tube can be held horizontally for 5 seconds without its content (a crystalline waxy mass) beginning to flow. This temperature is called the setting point of the test material. During the cooling of the test tube it is lifted out of the cooling bath every temperature decrease of 3° C. The temperature reading immediately before the setting point is reached is the lowest temperature observed at which the waxy mixture flows. This temperature is called the pour point of the test material.

EXAMPLE 10

A middle distillate fuel composition was prepared by dissolving 300 ppm of polymer 4 in a middle distillate fuel having a pour point of (—) 15° C, a cloud point of (—) 12° C, a 10% boiling point of 222° C and a 90% boiling point of 315° C. The pour point of the fuel composition was determined by the method described under Examples 8 and 9 and was found to be (—) 18° C.

What is claimed is:

1. An oil composition comprising a lubricating oil and from 0.025 to 10%w of substantially linear polymer selected from the group consisting of an acyclic polymer of cyclopentene, acyclic polymers of cyclopentene which have been partially hydrogenated to remove less than 70% of the initial unsaturation of the acyclic polymer, and mixtures thereof, said linear polymer having a molcular weight of between $1.0 \times 10^4$ and $3.0 \times 10^5$.

2. An oil composition as in claim 1, wherein the acyclic polymer has a molecular weight in the range from about $3.0 \times 10^4$ to about $1.5 \times 10^5$, inclusive.

3. An oil composition as in claim 1 wherein the substantially linear polymer is present in an amount from about 0.1 to 4.5%w.

* * * * *